US006508660B2

(12) United States Patent
Self

(10) Patent No.: US 6,508,660 B2
(45) Date of Patent: Jan. 21, 2003

(54) METALLIC SHROUD FOR USE WITH BOARD-MOUNTED ELECTRONIC CONNECTORS

(75) Inventor: Bobby J Self, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/773,074

(22) Filed: Jan. 31, 2001

(65) Prior Publication Data

US 2002/0115333 A1 Aug. 22, 2002

(51) Int. Cl.[7] ..... H01R 13/64
(52) U.S. Cl. ..... 439/374; 437/607; 437/674
(58) Field of Search ..... 439/607, 609, 439/374, 377, 325, 327, 79, 674, 677, 680, 633

(56) References Cited

U.S. PATENT DOCUMENTS 4,535,534 A * 8/1985 Ohashi et al. ..... 29/832
5,725,386 A * 3/1998 Davis et al. ..... 439/79
6,236,574 B1 * 5/2001 Han ..... 361/816
6,267,624 B1 * 7/2001 Wu et al. ..... 439/607

FOREIGN PATENT DOCUMENTS

GB 2160719 A * 12/1985 ..... 439/607

* cited by examiner

*Primary Examiner*—Gary Paumen
*Assistant Examiner*—James R. Harvey
(74) *Attorney, Agent, or Firm*—Kyle J. Way

(57) ABSTRACT

A shroud for a rectangular PCB-mounted electronic connector fashioned from a single piece of metal surrounds the connector on three sides of the connector by way of three walls. The fourth side of the connector is also partially covered via flanges extending from the end walls of the shroud. The walls and flanges of the shroud extend higher than the connector, thus defining a channel that aligns a mating structure for the connector when the mating structure is being plugged into the connector.

10 Claims, 1 Drawing Sheet

METALLIC SHROUD FOR USE WITH BOARD-MOUNTED ELECTRONIC CONNECTORS

BACKGROUND OF THE INVENTION

With the operating speed of many electronic devices entering the gigahertz range, smaller physical distances and geometries in electronic product design have become necessary to limit deleterious transmission line effects, such as electronic signal reflections and oscillations. One of several design areas affected by these advances in operating speed is interconnection methodology. In response to these advances, electronic connectors utilized on printed circuit boards (PCBs) have had to become smaller while simultaneously containing more signal conductors, or "pins."

Such small board-mounted connectors, being generally rectangular in shape, typically create problems for the people responsible for plugging a corresponding mating structure, such as the head of a cable assembly, into the connector. The pins of the connector are often so small and so closely positioned next to each other that even a minute misalignment of the connector and its mating structure during the plugging process may cause some of the proper connections to not be made. In some cases, this misalignment may actually cause permanent damage to the pins of the connector or mating structure. One example of such a connector is the Samtec ASP-65067-01, which is a 100-pin rectangular connector that is less than two inches long.

To remedy the alignment problem, some mechanical designers have developed shrouds that are soldered to a PCB and essentially encircle the board connector. The shroud then properly aligns the mating structure with the connector during the plugging process. However, such shrouds are generally made of plastic, thus making the shrouds somewhat expensive to manufacture, and require a significant amount of board space around the connector. Also, some specialized connectors actually contain an integrated shroud, but most are rather expensive when compared to unshrouded connectors.

As a result, many electronics manufacturers would probably appreciate an inexpensive shroud requiring a minimum of PCB space that aids in aligning an unshrouded rectangular connector with its mating structure.

SUMMARY OF THE INVENTION

Specific embodiments according to the present invention, to be described herein, entail a metallic connector shroud for a rectangular electronic connector. The connector is essentially a housing fashioned from a single piece of metal that forms three walls that surround three sides of the connector, as well as a pair of flanges that cover a portion of the fourth side of the connector. The top of the walls and flanges of the housing extend higher than the sides of the connector, thus defining a channel which helps to align a mating structure, such as the head of a cable assembly, with the connector during the plugging process. The housing also has at least one leg extending from the bottom of at least one wall that projects through a corresponding hole in the printed circuit board upon which the connector is mounted. The at least one leg would then normally be soldered to the board to provide structural stability.

Other aspects and advantages of the invention will become apparent from the following detailed description, taken in conjunction with the accompanying drawing, illustrating by way of example the principles of the invention.

DETAILED DESCRIPTION

Figure 1:
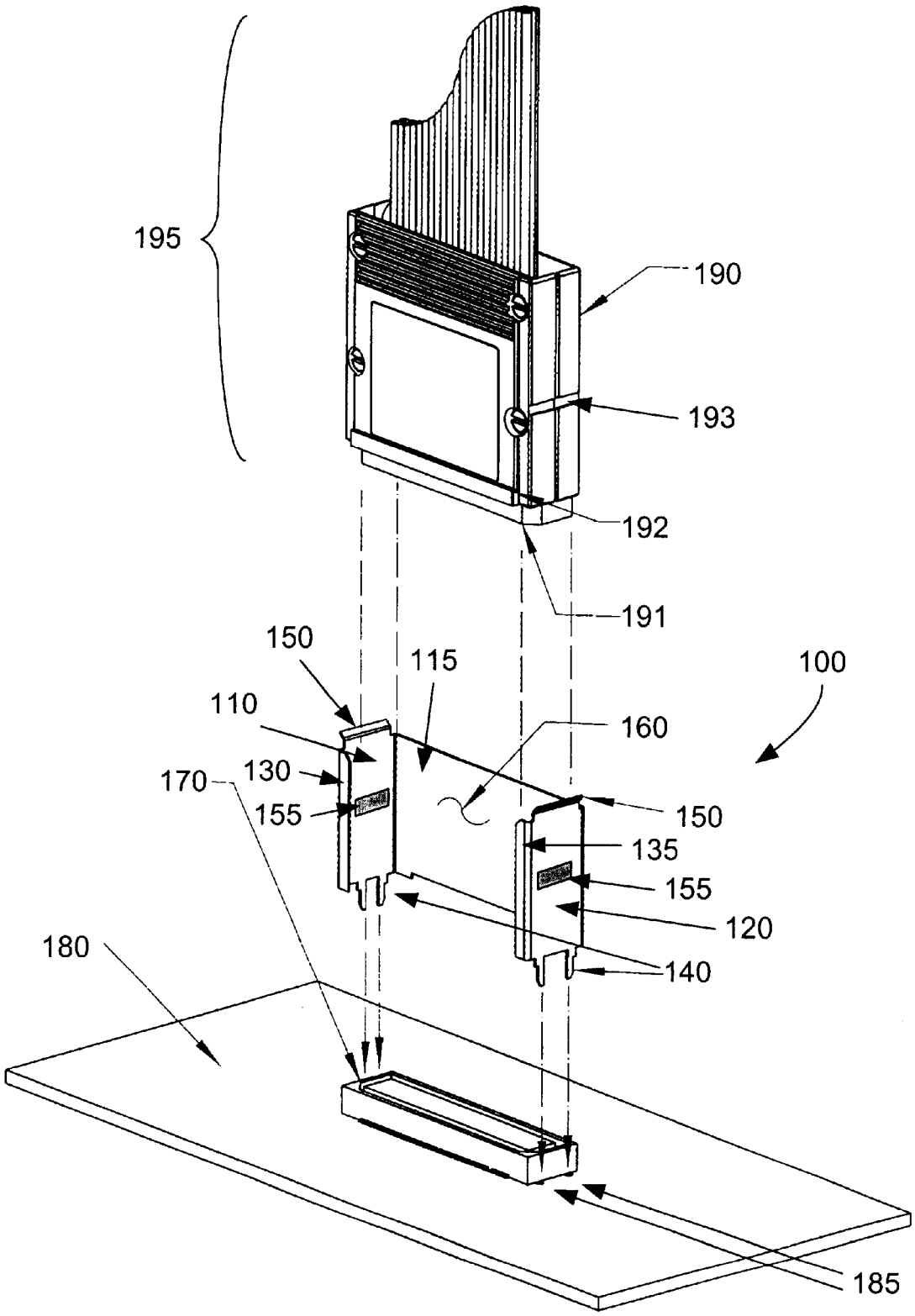
FIG. 1 is a perspective view of a connector shroud according to an embodiment of the invention, along with an associated PCB-mounted rectangular connector and mating head of a cable assembly.

A connector shroud 100 according to an embodiment of the invention is shown in FIG. 1. In this case, shroud 100 is used in conjunction with an electronic connector 170 mounted on a printed circuit board 180 that connects with a corresponding mating area 191 of a head 190 of a cable assembly 195. According to one embodiment, shroud 100 is fashioned from a single flat piece of metal, which may be, but is not limited to, nickel-plated stainless steel. Also, in some embodiments, the thickness of the metal is approximately 0.010 inches, although many other thicknesses are useful as well, depending on the particular connector application. Fashioning shroud 100 from a single flat piece of metal allows a rather simple manufacturing process, and also reduces the amount of space on circuit board 180 required by shroud 100. The nickel in this particular embodiment allows shroud 100 be soldered to printed circuit board 180, as is discussed below.

The metal forms a first wall 110, a second wall 115, and a third wall 120, with each wall juxtaposed with an external side of connector 170. Adjoining first wall 110 and second wall 120 are flanges 130 and 135, respectively, which are juxtaposed with the remaining external side of connector 170. Walls 110, 115 and 120, as well as flanges 130 and 135, extend higher than the external sides of connector 170 so that a channel 160 is formed which properly aligns head 190 of cable assembly 195 with connector 170 when head 190 is being plugged into connector 170. With proper alignment, the probability of damaging the conductors (not shown) of either head 190 or connector 170 is substantially eliminated. Additionally, the use of flanges 130 and 135, as opposed to a fourth wall, would normally allow direct visibility of the connection between head 190 and connector 170. In alternate embodiments, flanges 130 and 135 could extend farther along the remaining external side of connector 170, possibly even touching each other, which would lend more rigidity to shroud 100 at the expense of the direct visibility of the connection between head 190 and connector 170.

Flanges 130 and 135 may also provide a keying function, as shown in FIG. 1. In this instance, a raised portion 192 of head 190 corresponds to the open area between flanges 130 and 135, allowing head 190 to enter channel 160 defined by shroud 100. Conversely, if head 190 is rotated 180 degrees about the axis defined by channel 160, raised portion 192 will prevent head 190 from being inserted into channel 160 because of interference with second wall 115. Hence, head 190 is effectively forced into its correct orientation with channel 160 by the keying action of flanges 130 and 135.

In the embodiment of FIG. 1, legs 140 snap into holes 185 on printed circuit board 180 that are positioned along one or more of the external sides of connector 170. Legs 140 are then soldered into circuit board 180 to stabilize shroud 100 so that it will not move while head 190 is being plugged into connector 170. The soldering also aids in stabilizing the head/connector assembly, guarding against the possibility of head 190 becoming unplugged inadvertently. Additionally, soldering shroud 190 to printed circuit board 180 in some circumstances would allow printed circuit board 180 to be oriented other than in a horizontal fashion while maintaining the head/connector connection. Alternately, fewer legs 140 may be utilized than what is shown in FIG. 1. Even one leg 140 on one of the three walls 110, 115, or 120 may be employed, depending on the particular application in which shroud 100 is used.

Alternately, the spacing or positioning of legs 140 adjoining one wall may be different from that of legs 140 along another wall. In FIG. 1, for example, legs 140 of first wall 110 are more closely positioned to each other than are legs 140 of second wall 120. Such positioning essentially aligns legs 140 with holes 185 of circuit board 180 so that shroud 100 may be installed in only one orientation. When this leg and hole configuration is used in conjunction with the keying provided by flanges 130 and 135, head 190 and connector 170 must be oriented properly with respect to each other before a connection between the two can be made.

The embodiment of FIG. 1 also shows guide ramps 150 adjoining the tops of first wall 110 and third wall 120. Guide ramps 150 aid the user when attempting to slide head 190 into channel 160. Other embodiments may employ a similar guide ramp adjoining the top of second wall 115, while others may use various combinations of guide ramps 150, or no guide ramps at all.

As also indicated in FIG. 1, one or more detents 155 in one or more of walls 110, 115, and 120 may be used in some embodiments to mate with corresponding grooves 193 of head 190 when the connection between head 190 and connector 170 has been made. Detents 155 would thus provide a force that tends to strengthen the mechanical connection between head 190 and connector 170. Detents 155 could be utilized in any or all of walls 110, 115, and 120, depending on the physical characteristics of head 190. Alternately, detents 155 may not be utilized at all in some embodiments.

What is claimed is:

1. A connector shroud for a rectangular electrical connector having four external sides, the connector being mounted on a printed circuit board, the shroud being separate from the connector, the shroud comprising:

a housing fashioned from a single piece of metal, the housing having a first wall, a second wall, and a third wall, each wall juxtaposed with, and extending higher than, one of the external sides of the connector, the second wall connected to and positioned between the first and third wall, the first and third walls each having a flange extending from the ends of the first and third walls opposite the second wall, the flanges juxtaposed with, and extending higher than, the remaining external side of the connector not juxtaposed with one of the three walls of the housing, the walls and the flanges thereby substantially surrounding the connector and defining a channel that properly aligns a mating structure for proper connection with the connector, the housing having a plurality of leg pairs, at least two of the walls each having at least one of the leg pairs extending downward from the bottom of the walls so that each of the legs of the leg pairs projects through a corresponding hole in the printed circuit board, thereby allowing each of the legs of the leg pairs to be soldered to the printed circuit board, the distance between the legs of one of the leg pairs being substantially less than the distance between the legs of another of the leg pairs so that the housing may be attached to the printed circuit board in only one possible orientation.

2. The connector shroud of claim 1, wherein the housing is made of nickel-plated stainless steel.

3. The connector shroud of claim 2, wherein the nickel-plated stainless steel is approximately 0.010 inches thick.

4. The connector shroud of claim 1, farther comprising:

at least one guide ramp extending from the top of at least one of the walls of the housing to guide the mating structure into the channel defined by the walls of the housing.

5. The connector shroud of claim 4, wherein the first and third walls of the housing each have at least one guide ramp.

6. The connector shroud of claim 1, wherein the flanges mate with the mating structure so that the mating structure may be inserted into the channel of the housing in only one possible orientation.

7. The connector shroud of claim 1, further comprising at least one detent in at least one of the walls of the housing that aids the mating structure in maintaining proper electrical contact with the connector.

8. The connector shroud of claim 7, wherein the at least one detent is in each of the first and third walls of the housing.

9. The connector shroud of claim 7, wherein the at least one detent extends substantially the width of the wall in which the at least one detent resides.

10. A connector shroud for a rectangular electrical connector having four external sides, the connector being mounted on a printed circuit board, the shroud being separate from the connector, the shroud comprising:

a housing fashioned from a single piece of metal, the housing having a first wall, a second wall, and a third wall, each wall juxtaposed with, and extending higher than, one of the external sides of the connector, the second wall connected to and positioned between the first and third wall, the first and third walls each having a flange extending from the ends of the first and third walls opposite the second wall, the flanges juxtaposed with, and extending higher than, the remaining external side of the connector not juxtaposed with one of the three walls of the housing, the walls and the flanges thereby substantially surrounding the connector and defining a channel that properly aligns a mating structure for proper connection with the connector, the flanges mating with the mating structure so that the mating structure may be inserted into the channel of the housing in only one possible orientation, the housing having a plurality of leg pairs, at least two of the walls each having at least one of the leg pairs extending downward from the bottom of the walls so that each of the legs of the leg pairs projects through a corresponding hole in the printed circuit board, thereby allowing each of the legs of the leg pairs to be soldered to the printed circuit board, the distance between the legs of one of the leg pairs being substantially less than the distance between the legs of another of the leg pairs so that the housing may be attached to the printed circuit board in only one possible orientation, the housing having at least one guide ramp extending from the top of at least one of the walls of the housing to guide the mating structure into the channel defined by the walls of the housing.

* * * * *